United States Patent [19]

Tower

[11] Patent Number: 4,466,491

[45] Date of Patent: Aug. 21, 1984

[54] APPARATUS FOR REMOVING ROCKS AND OBJECTS

[76] Inventor: Douglass G. Tower, 724 Somerset Ave., Princess Anne, Md. 21853

[21] Appl. No.: 393,614

[22] Filed: Jun. 30, 1982

[51] Int. Cl.[3] ..... E02F 3/76; E02F 5/30; A01B 63/106; A01B 63/118

[52] U.S. Cl. ..... 172/459; 172/463; 172/476; 172/699; 172/136; 172/811; 299/42; 37/2 R; 37/DIG. 3

[58] Field of Search ..... 172/474, 478, 484, 459, 172/456, 460, 463, 464, 476, 273, 298, 810, 811, 305, 253, 136, 475; 404/90; 37/2 R, DIG. 3, 12, 17.5; 299/34, 36; 405/268

[56] References Cited

U.S. PATENT DOCUMENTS

| | | | |
|---|---|---|---|
| 2,238,094 | 4/1941 | Allin | 37/2 R |
| 2,630,052 | 3/1953 | Jory | 172/460 X |
| 2,718,719 | 9/1955 | Anderson | 172/739 X |
| 3,050,135 | 8/1962 | Kelly | 172/734 |
| 3,146,686 | 9/1964 | Grace | 172/460 |
| 3,429,381 | 2/1969 | Launder et al. . | |
| 3,430,706 | 3/1969 | Marron . | |
| 3,464,499 | 9/1969 | McKell . | |
| 3,503,456 | 3/1970 | Larson | 172/484 |
| 3,613,923 | 5/1971 | Albright | 37/117.5 |
| 4,063,597 | 12/1977 | Day | 172/126 |
| 4,079,791 | 3/1978 | Yoder et al. . | |
| 4,204,578 | 5/1980 | Stedman | 172/484 |
| 4,219,947 | 9/1980 | Paladino | 172/744 |

FOREIGN PATENT DOCUMENTS

| | | | |
|---|---|---|---|
| 48201 | 1/1982 | U.S.S.R. | 37/117.5 |

*Primary Examiner*—Richard J. Johnson
*Attorney, Agent, or Firm*—Berman, Aisenberg & Platt

[57] ABSTRACT

Apparatus is provided for moving objects which may be partially buried. The apparatus comprises a hook-like element which may be attached to the side of a vehicle, such as a bulldozer. The hook-like element is pivotally attached so that its orientation is adjustable.

A method of moving objects is disclosed where a hook-like element extending from the side of a vehicle engages the objects to be moved.

9 Claims, 5 Drawing Figures

APPARATUS FOR REMOVING ROCKS AND OBJECTS

TECHNICAL FIELD

This invention relates to the art of implements, which may be attached to a vehicle, for moving an object.

BACKGROUND ART

A commonly used vehicle for moving earth is a bulldozer. A bulldozer is usually fitted with a blade which is attached to the bulldozer by a pair of arms. Each of the arms is pivotally attached to the bulldozer at one end, and the blade may be raised or lowered relative to the bulldozer.

A known device for digging-out rocks is a ripper which attaches to the rear of a vehicle, such as a bulldozer. In order to remove a boulder, the bulldozer straddles the buried boulder, allowing the tooth of the ripper to engage the boulder as the bulldozer passes over it.

Devices are also known which extend outwardly from the blade of a bulldozer for shaping a slope.

U.S. Pat. No. 3,429,381 shows a slope blade (for a bulldozer) which comprises a blade pivotally mounted to a hinge, which is pivotally mounted for rotation about a vertical axis. A hydraulic cylinder extends from the hinge to the blade to pivot the blade about a horizontal axis, and an adjustable arm extends from another arm (attached to the bulldozer) to the blade for adjustment of the blade about a vertical axis.

U.S. Pat. No. 3,430,706l shows an attachment which is pivotally mounted to a bulldozer blade. The attachment rotates about a vertical axis in response to the extension of a hydraulic cylinder.

U.S. Pat. No. 3,464,499 shows a blade for shaping a slope. The blade is attached to a bulldozer arm and is rotatable about a horizontal axis which is generally parallel to the direction of the arm.

U.S. Pat. No. 4,079,791 shows an adjustable blade for attachment to a bulldozer. The blade is pivotally mounted for rotation about a horizontal axis in response to action of a hydraulic cylinder.

STATEMENT OF THE INVENTION

When moving earth to provide a slope, the slope is typically cut in a stairstep manner also known as a serration cut. Thus, earth is moved out of horizontal volumes the height of one step, and each succeeding horizontal volume is horizontally displaced the width of the step. This technique leaves a triangular-shaped step which can be graded later to produce a smooth slope.

It is common to have boulders embedded in the earth being moved, and these boulders are typically moved by the use of a ripper which descends from the rear of a bulldozer. The bulldozer must drive over the boulder so that the ripper can engage the boulder, to break the boulders up.

In some instances, a boulder or other objects is embedded in the triangular-shaped stairstep volume after the horizontal volume of dirt has been removed. In this instance, the removal of a boulder is quite difficult, since it would require to bulldozer to back up the slope to engage the conventional ripper with the boulder. Slopes are typically too steep for this to be convenient and thus the operator of the bulldozer must rearrange the earth to allow the bulldozer to approach the boulder properly. This process usually involves pushing earth back into the area which had previously been excavated to provide a ramp upon which the bulldozer can approach the boulder. This process takes time and resources, and hence is expensive.

The invention is a device which attaches to the side of a bulldozer, preferably to an arm which supports a blade. The apparatus of the invention has a ripper which extends from a first arm of the apparatus, for engaging the boulder or other objects to be removed. The first arm supporting the ripper is pivotally attached to a second arm which is in turn pivotally attached to a main support bracket which is fixed to the bulldozer arm. The second arm is rotated with respect to the main support bracket by means of a hydraulic cylinder, and the first arm is rotated with respect to the second arm by means of another hydraulic cylinder. The ripper is secured in the first arm by means of a pin which may be retracted so that the extent to which the ripper extends from the arm may be adjusted.

It is an object of this invention to provide a ripper for engaging objects to be removed from soil and which extends from the side of an earth-moving vehicle.

It is an object of this invention to provide an apparatus for removing objects from the earth and employing a ripper which is pivotally attached to a vehicle.

It is a further object of this invention to provide a method for removing objects from the earth with a vehicle moving in a direction along a contour of a slope.

DETAILED DESCRIPTION OF THE INVENTION

Figure 1:
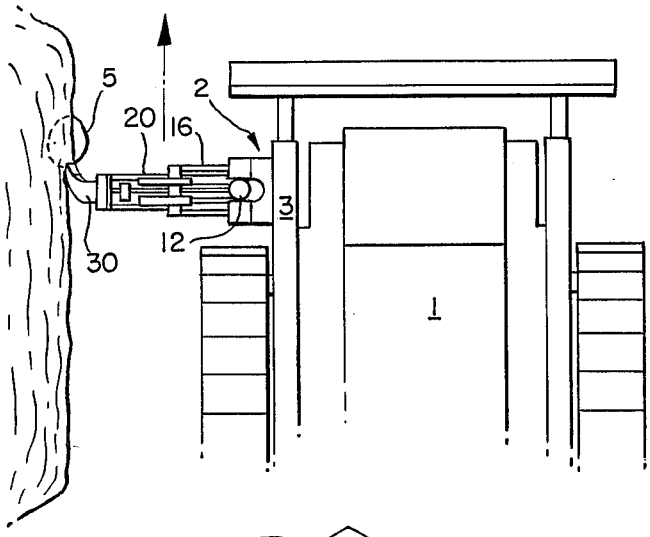
FIG. 1 is a top view of a bulldozer showing the invention attached thereto.

FIG. 1 shows how the apparatus of the invention may be employed to remove an object, such as rock 5, which is embedded in a slope adjacent a bulldozer 1. The apparatus of the invention allows the bulldozer to approach the object to be removed by driving along, or parallel to, the contour of the slope.

Figure 2:
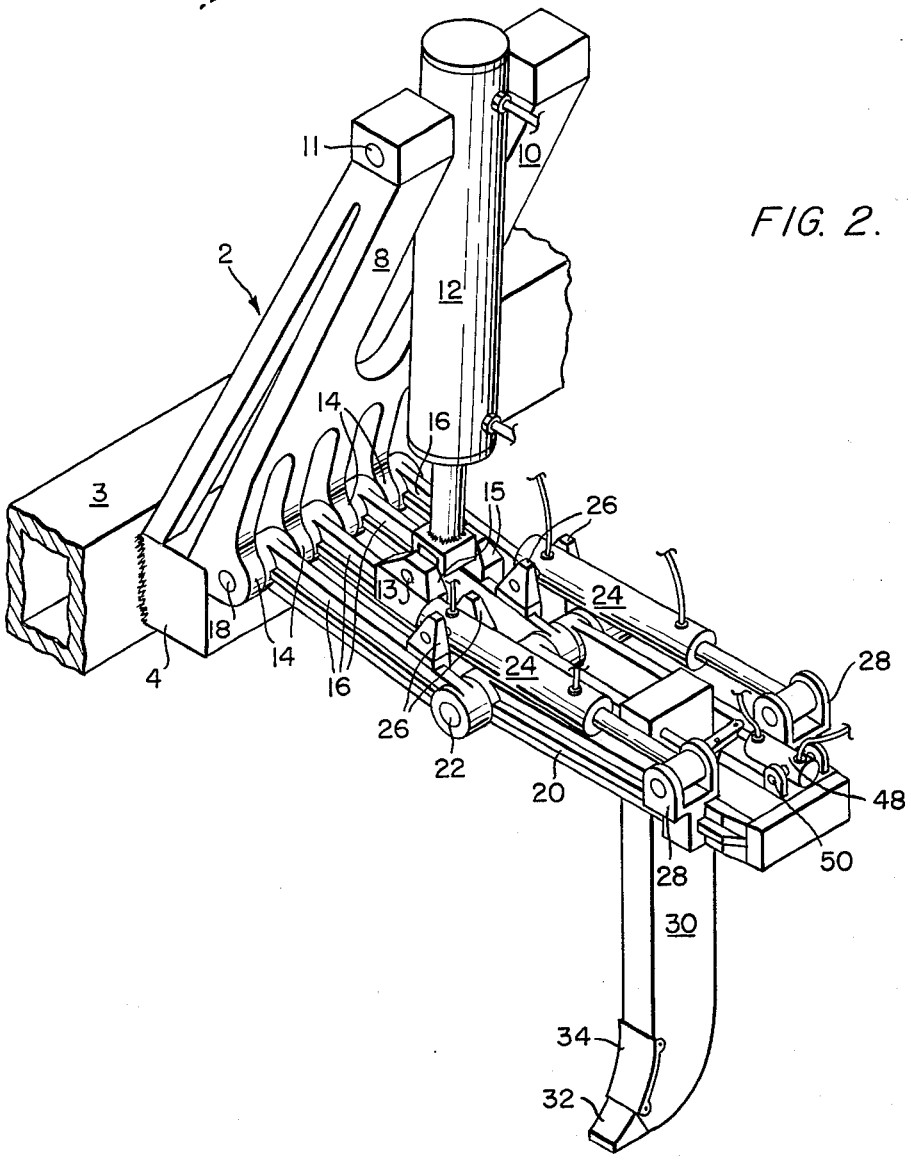
FIG. 2 is a perspective view of the apparatus of the invention.

FIG. 2 shows a perspective view of the apparatus of the invention. A main support bracket 2, shown attached to an arm 3, includes a rectangular portion 4 and main support arms 8 and 10. The rectangular portion 4 is adapted to be fixed to the side of a piece of heavy equipment, for example the arm of a bulldozer. The rectangular portion may be attached by any known method, for example by bolting or by welding.

The main support arms 8 and 10 are shown tilted at an angle of about 60°, but may be at other angles, depending on the particular circumstances. A first hydraulic cylinder 12 is pivotally mounted between the main support arms 8 and 10. The main support bracket 2 also includes a plurality of bosses 14 which provide a hinge. Pivotally attached to the main support bracket 2 is a first arm 16. This first arm is pivotally attached at one end to the main support bracket 2 by a hinge pin 18 which passes through the bosses 14 and holes in one end of the first arm 16. The first arm 16 may comprise a plurality of elements extending parallel to each other, as shown in FIG. 1, or may be of other suitable construction.

The first hydraulic cylinder 12 is attached to the main support bracket 2 at one end, and to the first arm 16 at its other end. As shown in FIG. 2, the cylinder is attached between main support arms 8 and 10 by a pin 11, and is attached to arm 16 by a pin 13 extending through mounting blocks 15 which are fixed to arm 16.

A second arm 20 is pivotally attached to the other end of the first arm 16. A hinge pin 22 passes through holes in the first and second arms to provide the pivotal connection. Second and third hydraulic cylinders 24 extend between the first arm 16 and the second arm 20 for controlling the angular relationship between these arms. The respective ends of the hydraulic cylinders are pivotally mounted on blocks 26 on arm 16 and on brackets 28 on arm 20.

Ripper 30 is mounted on arm 20. Ripper 30 projects from the arm 20 in a direction which is generally perpendicular to the plane of arm 20. The ripper 30 is curved at one end, to produce a J-shaped claw section, so that the ripper is useful for removing objects from the earth. The ripper includes a removable tooth 32 and a replaceable wear plate 34 on the shank, which provides for easy repair of the ripper.

The hydraulic cylinders 12 and 24 are controlled by a mechanism, which has not been illustrated, and which is usually located adjacent the operator in the cab of the vehicle carrying the inventive apparatus. The operating mechanism may, for example, be a joy stick wherein movement in one direction activates hydraulic cylinder 12 and movement in a transverse direction activates the hydraulic cylinders 24.

Figure 3:
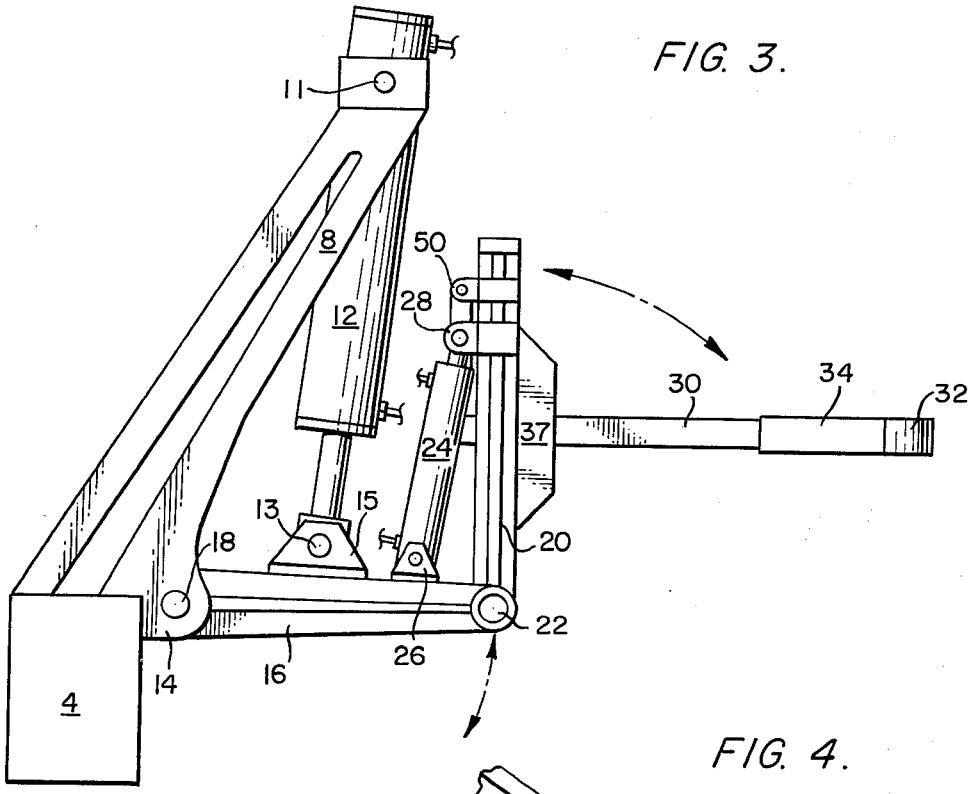
FIG. 3 is an end elevation view of the apparatus of the invention.

FIG. 3 shows the apparatus of the invention wherein the first arm 16 is generally horizontal and the second arm 20 is generally vertical, having been rotated to this position by the retraction of hydraulic cylinders 24. The ripper 30 is then generally horizontal and is in position for engaging an object embedded in a vertical portion of the earth.

As seen in FIGS. 2 and 3, the apparatus of the invention allows the ripper 30 to be oriented at a number of angles. The ripper is oriented in FIG. 2 for grasping objects located under a horizontal surface, whereas the ripper in FIG. 3 is oriented to remove an object from a vertical surface. Clearly, the ripper may be oriented to grasp an object in orientations other than these two specific ones, depending only upon the design parameters of the hydraulic cylinders.

Figure 4:
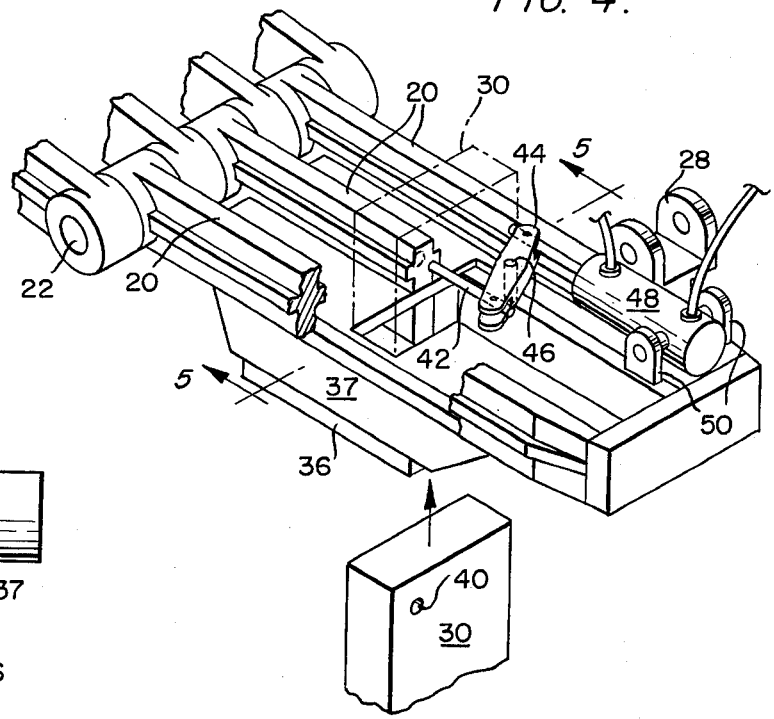
FIG. 4 is a perspective view of an arm of the invention.

FIG. 4 shows a perspective view of the second arm of the invention illustrating how the ripper 30 is retained in the support plate 36. The ripper is shown in phantom lines inserted in the support plate, and one of the elements of arm 20 is shown in vertically position. The shank of the ripper 30 has a hole 40 for receiving a pin 42. The pin 42 is connected to a lever 44 which is pivotally attached to the arm 20 by a hinge pin 46. The opposite end of the lever 44 is connected to a fourth hydraulic cylinder 48, which is mounted by bracket 50. Activation of the hydraulic cylinder 48 moves pin 42 to either engage or disengage the hole 40 in the shank of the ripper 30. When the pin 42 engages the hole 40 in the shank of the ripper, the ripper is held secure in the arm 20. On the other hand, when the pin is withdrawn from the hole 40, the ripper may be moved with respect to the arm 20. The weight of the ripper will move it downward whereas upward movement is accomplished by operating the hydraulic cylinders to push the ripper against the ground. Thus, the extent to which the ripper projects from arm 20 may be adjustable by providing a plurality of holes for engaging with the pin 42. The ripper 30 may also be removed from the arm 20 by withdrawing the pin 42.

Figure 5:
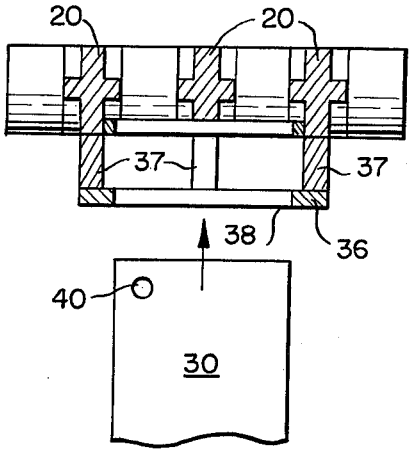
FIG. 5 is a cross-section of an arm of the invention taken through line 5—5 of FIG. 4.

FIG. 5 shows a cross-sectional view of the second arm 20. This arm includes a support plate 36 which forms a hole 38 for receiving the shank of the ripper 30. The support plate is attached to the arm 20 by brackets 37 or other suitable means, or may be integrally formed therewith. The plate 36 has a thickness adequate to support the ripper 30, and the plate 36 may also include an extension (not shown) which extends above the second arm 20 to give additional support to the shank of the ripper 30.

The hydraulic cylinders 12 and 24 may be controlled by a known automatic levelling system which operates to maintain a given position of the ripper for various attitudes of the vehicle.

It is clear that a bulldozer, or other vehicle may have an apparatus of the invention on each side of the bulldozer, and may have more than one on each side.

As will be appreciated by those of skill in the art, the apparatus of the invention represents a significant improvement over the prior art. Instead of having to build a ramp to facilitate the bulldozer's approach to the object for use of the conventional implement, the bulldozer need only approach the object to be removed by driving along, or parallel to, the slope. The ripper may then be oriented to grasp the object, and the force of the ripper on the object will remove it, whether the object is on a slope or conventionally rough or smooth terrain at ground level and/or below ground.

While a particular embodiment of the invention has been shown and described, it should be understood that other embodiments covered by the claims will be apparent to those of skill in the art.

I claim:

1. A ripper apparatus comprising a main upright support bracket adapted to be secured to a vehicle, a first arm means pivotally mounted at a first end thereof to said bracket for pivotal movement about a first axis, a second arm means mounted to a second end of said first arm means for pivotal movement about a second axis substantially parallel to said first axis, first power means positioned between said bracket and said first arm means for rotationally positioning said first arm means about said first axis, second power means connected between said first and second arm means for rotationally positioning said second arm means about said second axis, and ripper shank means for engaging and removing embedded objects and extending from said second arm means generally perpendicular to said second arm means, said first and second power means being selectively operable to position said shank in a range of positions in a plane transverse to said first axis.

2. The apparatus of claim 1 wherein said bracket means comprises an upstanding portion having said first force means extending from an upper end of said portion to said first arm means, and wherein said first and said second force means respectively comprise first and second variable length means, said second variable length means having respective ends pivotally mounted to said first arm means and said second arm means.

3. Apparatus according to claim 1 further comprising means for securing said ripper means to said second arm means in a plurality of positions so that the amount by which said ripper projects from said second arm means is adjustable.

4. Apparatus according to claim 3 wherein said means for securing comprises:

a recessed portion in a shank of said ripper, and a pin on said second arm means for engaging or releasing said recessed portion.

5. Apparatus according to claim 1 further comprising means for mounting said ripper means to said vehicle so that said ripper means may be oriented at various angles in a plane transverse to a direction of motion of said vehicle.

6. Apparatus according to claim 1, wherein said vehicle is a bulldozer, and said means for mounting includes a main support bracket for pivotally attaching said first arm to an arm which supports an earth-moving blade.

7. Apparatus according to claim 1 wherein said first and second power means comprise hydraulic cylinders.

8. A vehicle adapted to move along a first direction, comprising a longitudinally extending tool support member, a first arm secured to said member and extending laterally outwardly from said vehicle in a second direction transverse to said first direction and mounted to said vehicle for pivotal motion about a first axis generally parallel to said first direction, a second arm mounted to said first arm for pivotal motion about a second axis substantially parallel to said first axis, and ripper shank means extending transversely to said second arm said ripper shank means being positioned in a plane parallel to said second axis and terminating in a tip end adapted to engage and remove embedded objects, and separate power means for pivoting said first arm about said first axis and said second arm about said second axis, whereby said shank may be selectively angularly adjusted in a range of operative use in a plane transverse to said vehicle.

9. A method of removing embedded objects comprising:

attaching a ripper means for engaging and removing objects to the side of a vehicle;

moving said objects by moving said vehicle in a direction so that said ripper means engages said object;

wherein said ripper means is pivotally attached to said vehicle and extends laterally outwardly for angular motion in a plane transverse to said direction, and wherein said ripper means may be selectively angularly adjusted in a range of positions in said plane.

* * * * *